United States Patent [19]

Ochiai et al.

[11] Patent Number: 4,913,635

[45] Date of Patent: Apr. 3, 1990

[54] SCROLL TYPE COMPRESSOR WITH SEALING STRUCTURE FOR FIXED SCROLL END PLATE

[75] Inventors: Yoshihiro Ochiai, Isesaki; Masashi Yaguchi, Takasaki; Yoshio Kimura, Maebashi, all of Japan

[73] Assignee: Sanden Corporation, Gunma, Japan

[21] Appl. No.: 177,117

[22] Filed: Apr. 4, 1988

[30] Foreign Application Priority Data

Apr. 4, 1987 [JP] Japan ..... 62-50617[U]

[51] Int. Cl.[4] ..... F04C 18/04; F04C 27/00; F16J 15/02

[52] U.S. Cl. ..... 418/55; 418/149; 277/168; 277/170

[58] Field of Search ..... 418/55 R, 55 A, 55 C, 418/149; 277/168, 170, 171

[56] References Cited

U.S. PATENT DOCUMENTS

| | | | |
|---|---|---|---|
| 2,728,300 | 12/1955 | Stoermer | 418/149 |
| 2,922,376 | 1/1960 | Hankel et al. | 418/149 |
| 3,132,869 | 5/1964 | Campbell | 277/171 |
| 3,490,383 | 1/1970 | Parrett | 418/149 |
| 4,456,435 | 6/1984 | Hiraga et al. | 417/302 |
| 4,571,163 | 2/1986 | Sakamoto et al. | 418/55 R |

FOREIGN PATENT DOCUMENTS

| | | | |
|---|---|---|---|
| 470609 | 5/1969 | Switzerland | 270/170 |

*Primary Examiner*—John J. Vrablik

*Attorney, Agent, or Firm*—Banner, Birch, McKie & Beckett

[57] ABSTRACT

A scroll type compressor includes a housing having an inner chamber and fluid inlet and outlet ports connected to the inner chamber. A fixed scroll is mounted within the housing and has a circular end plate from which a first spiral element extends. An orbiting scroll is also mounted within the housing for orbital motion with respect to the fixed scroll, and includes a circular end plate from which a second spiral element extends. The fixed scroll and the orbiting scroll are maintained angularly and radially offset from each other so that the spiral elements interfit to form a plurality of line contacts between their spiral curved surfaces which seal-off and define at least one pair of fluid pockets. The orbital movement of the orbiting scroll relative to the fixed scroll shifts the line contacts along the spiral curved surfaces of the spiral elements which changes the volume of the fluid pockets. The end plate of the fixed scroll partitions the inner chamber of the housing into a suction chamber and a discharge chamber. A sealing structure is disposed between the inner peripheral wall of the housing and the outer peripheral surface of the end plate of the fixed scroll. The sealing structure includes an annular cut-out portion, having an L-shaped sectional side view, formed in the outer peripheral surface of the end plate of the fixed scroll, an annular ridge formed in the inner peripheral wall of the housing and an O-ring seal element disposed between the annular cut-out portion and the annular ridge.

4 Claims, 5 Drawing Sheets

SCROLL TYPE COMPRESSOR WITH SEALING STRUCTURE FOR FIXED SCROLL END PLATE

BACKGROUND OF THE INVENTION

This invention relates to a scroll type refrigerant compressor, and more particularly, to a sealing structure for insulating the suction chamber and the discharge chamber of the compressor casing.

Scroll type refrigerant compressors are well known in the prior art. For example, Japanese Patent Application Publication No. 56-156492 discloses such a compressor which includes two scrolls, each having a circular end plate and an involute spiral element. The scrolls are maintained angularly and radially offset from each other so that the spiral elements interfit to form a plurality of line contacts between their spiral curved surfaces to thereby seal off and define at least one pair of fluid pockets. The relative orbital motion of the two scrolls shifts the line contacts along the spiral curved surfaces and, as a result, the volume of the fluid pockets decreases with compression.

Referring to FIG. 1, a scroll type refrigerant compressor 1 in accordance with the prior art is shown. Compressor 1 includes a compressor housing 10 having a front end plate 11 and a cup shaped casing 12, which is attached to the rearwardly facing surface of front end plate 11 to define an inner chamber between the inner wall of casing 12 and the surface of front end plate 11. Disposed within the inner chamber of cup shaped casing 12 are a fixed scroll 13 having a circular end plate 131 from which a spiral element 132 extends, an orbiting scroll 14 having a circular end plate 141 from which a spiral element 142 extends, a driving mechanism 15 and a rotation preventing/thrust bearing device 16. A drive shaft 151 penetrates an opening 111 in front end plate 11 and is rotatably supported by front end plate 11 through a bearing 17. Driving mechanism 15 is operatively coupled to drive shaft 151, and is connected to orbiting scroll 14 to effect orbital movement of the orbiting scroll during rotation of the drive shaft. Rotation of orbiting scroll 14 is prevented by rotation preventing/-thrust bearing device 16. Scrolls 13 and 14 are maintained regularly and radially offset from each other so that spiral elements 132, 142 interfit to form a plurality of line contacts between their spiral curved surfaces which seal-off and define at least one pair of fluid pockets. The orbital movement of orbiting scroll 14 relative to fixed scroll 13 shifts the line contacts along the spiral curved surfaces of spiral elements 132, 142 which changes the volume of the fluid pockets.

Circular end plate 131 of fixed scroll 13 partitions the inner chamber of cup shaped casing 12 into a suction chamber 18 and a discharge chamber 19. A sealing structure 20 (FIG. 2) is formed in the outer peripheral wall of circular end plate 13 to insulate suction chamber 18 and discharge chamber 19. The sealing structure 20 includes a circumferential groove 21 formed in the outer peripheral surface of circular end plate 131 and an O-ring seal element 22 disposed in the circumferential groove 21.

Formation of circumferential groove 21 is accomplished by a cutting process, comprising seven steps, shown in FIGS. 3*a* through 3*g* in which circular end plate 131 is mounted for rotation proximate a surface cutting tool. In a first step, shown in FIG. 3*a*, the outer peripheral surface 131*a* for circular end plate 131 and the outer circumferential portion 131*e* of the surface of circular end plate 131 are cut by a surface cutting tool 201 which is attached to a numerical controlled lathe (not shown). In steps 2–4, shown in FIGS. 3*b* through 3*d*, respectively, outer peripheral surface 131*a* of circular end plate 131 is cut by a groove cutting tool 202. Typically, groove cutting tool 202 will have a vertical sectional view similar to that of circumferential groove 21, i.e., the groove cutting tool 202 is used as a forming tool. The final steps in the process are shown in FIGS. 3*e* through 3*g*, in which the corners of circumferential groove 21 are rounded by groove cutting tool 202.

There are a number of problems associated with this technique for forming a circumferential groove in the outer peripheral surface of the circular end plate. One problem is that the tip of the groove cutting tool is easily broken, which destroys is utility as a forming tool. It is also difficult to precisely control the dimensions of the groove to within a certain standard because of sticking residual material left at the tip of the groove cutting tool and within the groove itself during the cutting operation. In addition, the process is time-consuming and requires a plurality of cutting tools.

SUMMARY OF THE INVENTION

It is a primary object of this invention to provide a scroll type compressor having a simplified sealing structure disposed between the inner peripheral wall of the housing and the outer peripheral surface of the end plate of the fixed scroll.

It is another object of this invention to improve the process for forming the sealing structure by eliminating the problems encountered in the prior art process, i.e., by precisely controlling the dimensions of the cut surface, by shortening cutting time and by reducing the number of cutting tools required.

A scroll type compressor according to this invention includes a housing having a fluid inlet port and a fluid outlet port. A fixed scroll is fixedly disposed in the housing and has an end plate from which a first spiral element extends. An orbiting scroll is also disposed in the housing and has an end plate from which a second spiral element extends. The end plate of the fixed scroll partitions an inner chamber of the housing into a suction chamber and a discharge chamber. A driving mechanism is operatively connected to the orbiting scroll and to a drive shaft to effect orbital motion of the orbiting scroll during rotation of the drive shaft. Rotation of the orbiting scroll is prevented by a rotation preventing device. The fixed scroll and the orbiting scroll are maintained angularly and radially offset from each other so that the spiral elements interfit to form a plurality of line contacts between their spiral curved surfaces which seal-off and define at least one pair of fluid pockets. The orbital movement of the orbiting scroll relative to the fixed scroll shifts the line contacts along the spiral curved surfaces of the spiral elements which changes the volume of the fluid pockets.

According to the present invention, a sealing structure, for insulating the suction chamber and the discharge chamber, is formed between the outer peripheral surface of the end plate of the fixed scroll and the inner peripheral wall of the housing. The sealing structure includes an annular cut-out portion, having a generally L-shaped sectional side view, formed in the outer peripheral surface of the end plate of the fixed scroll, an annular ridge formed in the inner peripheral wall of the housing and an O-ring seal element disposed between the annular cut-out portion and the annular ridge.

Further objects, features and other aspects of this invention will be understood from the detailed description of the preferred embodiment of this invention with reference to the annexed drawings.

DETAILED DESCRIPTION OF THE PREFERRED EMBODIMENT

Figure 4:
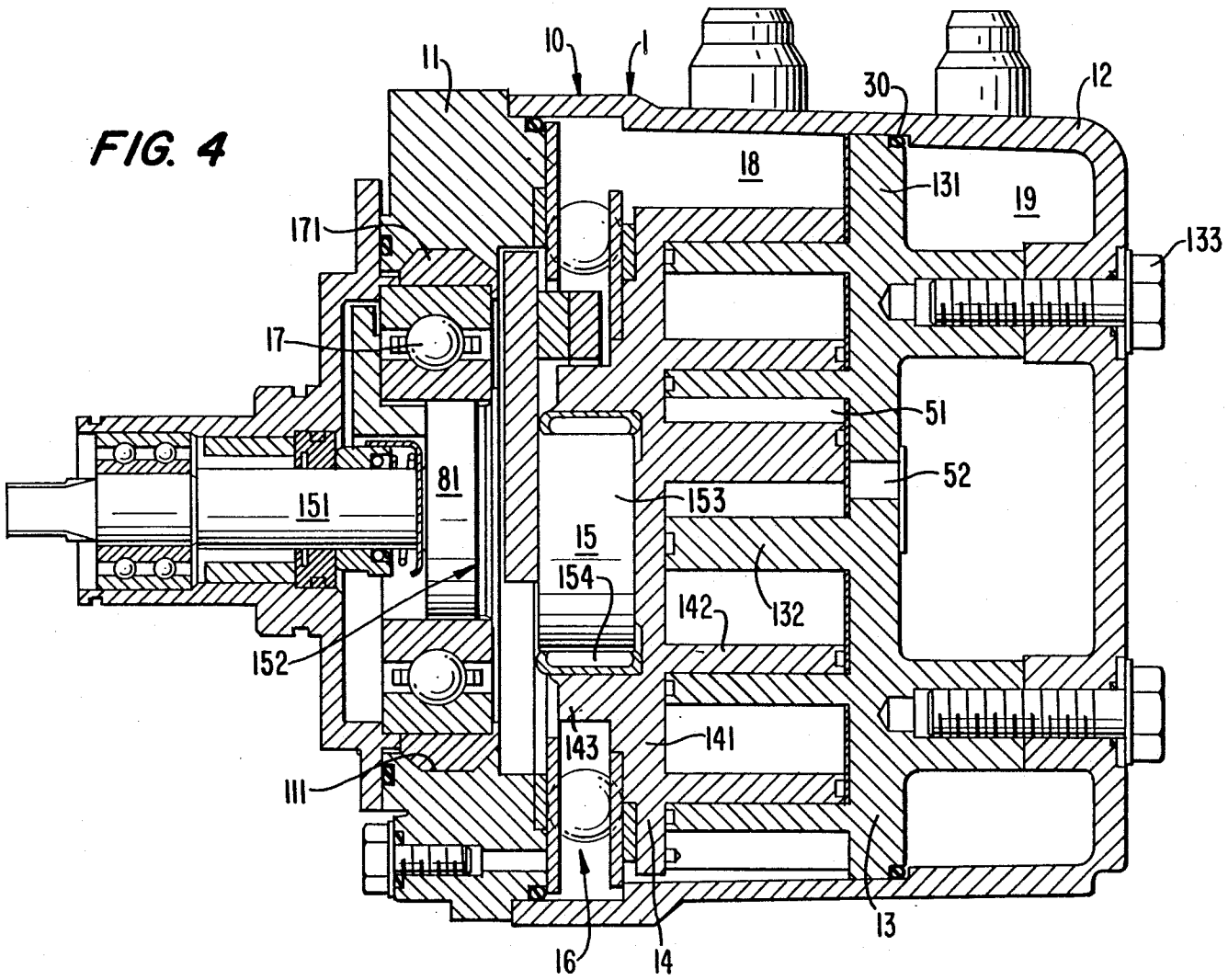
FIG. 4 is a vertical longitudinal sectional view of a scroll type compressor in accordance with one embodiment of the present invention.

Referring to FIG. 4, a scroll type refrigerant compressor 1 in accordance with one embodiment of the present invention is shown. Compressor 1 includes a compressor housing 10 having a front end plate 11 and a cup shaped casing 12, which is attached to an end surface of front plate 11 to define an inner chamber between the inner wall of casing 12 and the rearwardly facing surface of front end plate 11. Disposed within the inner chamber of cup shaped casing 12 are a fixed scroll 13 having a circular end plate 131 from which a spiral element 132 extends, an orbiting scroll 14 having a circular end plate 141 from which a spiral element 142 extends, a driving mechanism 15 and a rotation preventing/thrust bearing device 16. Fixed scroll 13 is fixed to the rear end plate of cup shaped casing 12 by screws 133. Scrolls 13 and 14 are maintained angularly and radially offset from each other so that spiral elements 132, 142 interfit to form a plurality of line contacts between their spiral curved surfaces which define at least one pair of sealed off fluid pockets 51. The circular end plate 141 of the orbiting scroll 14 is provided with a boss 143 projecting annularly from the surface of end plate 141 opposite the surface from which spiral element 142 extends. A drive shaft 151 penetrates an opening 111 of front end plate 11 and is rotatably supported by front end plate 11 through a bearing 17 and a sleeve 171.

Drive shaft 151 is operatively connected at one end with driving mechanism 15 which includes a disk shaped rotor 152 formed at the inner end of drive shaft 151, a driving pin (not shown) attached to the disk shaped rotor 152 eccentrically, and a bushing 153 connected to the driving pin. Bushing 153 is connected to orbiting scroll 14 through a bearing 154 which is disposed on the inner wall of boss 143. As drive shaft 151 is rotated, bushing 153 also tends to rotate eccentrically. However, rotation of orbiting scroll 14 is prevented by rotation preventing/thrust bearing device 16 so that orbiting scroll 14 exhibits orbital motion. The orbital movement of orbiting scroll 14 relative to fixed scroll 13 shifts the line contacts along the spiral curved surfaces of spiral elements 132, 142 which changes the volume of the fluid pockets with compression of the fluid. The compressed fluid is then discharged to a discharge chamber, described below, through a hole 52 formed in circular end plate 131 of fixed scroll 13.

Circular end plate 131 of fixed scroll 13 partitions the inner chamber of cup shaped casing 12 into a suction chamber 18 and a discharge chamber 19. A sealing structure 30, for insulating suction chamber 18 and discharge chamber 19, is formed between the outer peripheral surface of circular end plate 131 and the inner peripheral wall of cup shaped casing 12.

Figure 1:
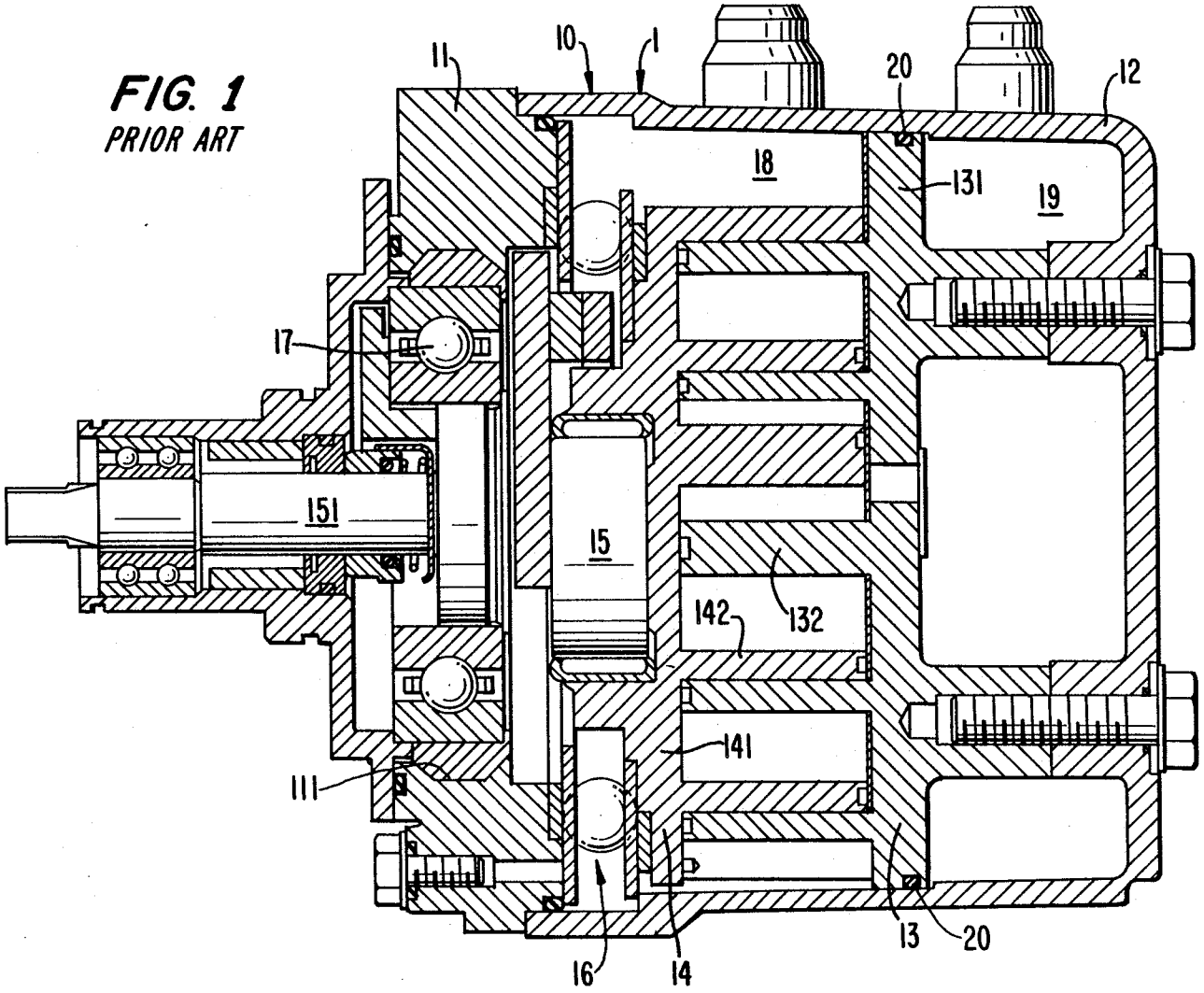
FIG. 1 PRIOR ART
FIG. 1 is a vertical longitudinal sectional view of a scroll type compressor in accordance with the prior art.
Figure 2:
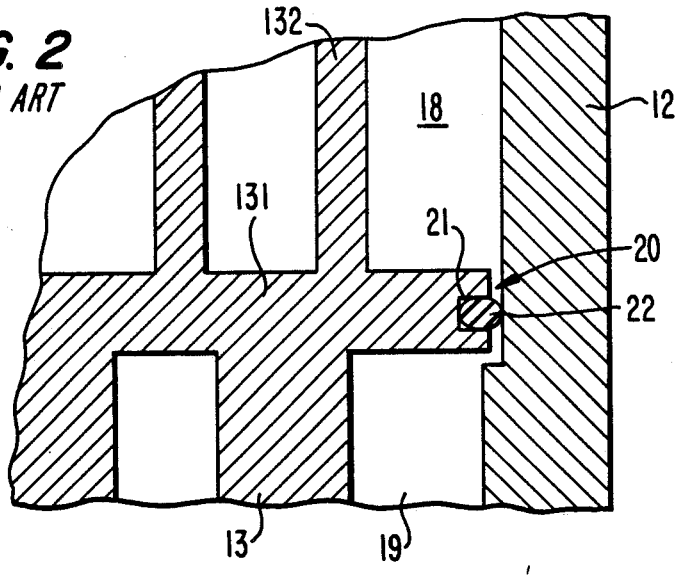
FIG. 2 PRIOR ART
FIG. 2 is a partial sectional fragmentary schematic view which shows a sealing structure in accordance with the prior art.
Figure 5:
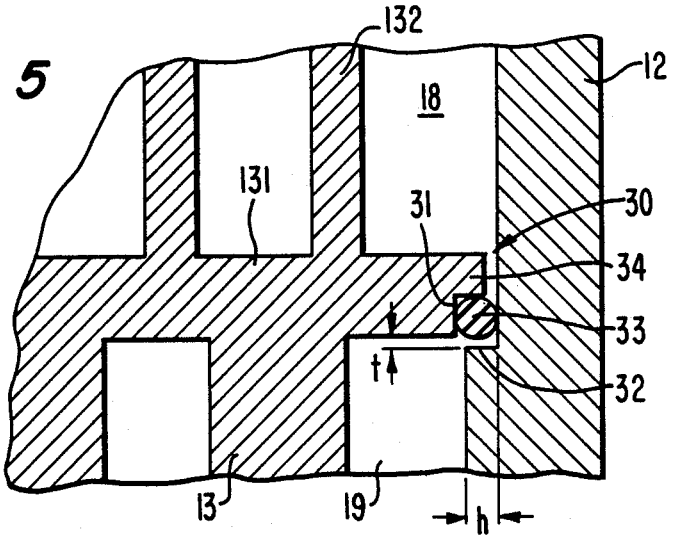
FIG. 5 is a partial sectional fragmentary schematic view which shows a sealing structure in accordance with one embodiment of the present invention.

Referring to FIG. 5, sealing structure 30 includes an annular cut-out portion 31, having an L-shaped sectional side view, formed in the outer peripheral surface of circular end plate 131, an annular ridge 32 formed in the inner peripheral wall of cup shaped casing 12 and an O-ring seal element 33 disposed between annular cut-out portion 31 and annular ridge 32.

The formation of annular ridge 32 is accomplished by a cutting process in which cup shaped casing 12 is mounted for rotation proximate a cutting tool, which is attached to a numerical controlled lathe. During rotation of casing 12, the cutting tool is controlled to move in a longitudinal direction along the inner surface of the casing and to cut away a portion of the peripheral surface of the inner wall of the casing. As a result of the cutting operation, the inner wall of at least a portion of discharge chamber 19 is thicker, by "h" in FIG. 5, than the inner wall of suction chamber 18 so that annular ridge 32 is formed. In accordance with the invention, annular ridge 32 is positioned at a distance from circular end plate 131 so that a gap, having width "t" in FIG. 5, is created between the rearwardly facing surface of circular end plate 131 and the surface of annular ridge 32 when fixed scroll 13 is fixedly secured to cup shaped casing 12. This gap prevents circular end plate 131 from contacting annular ridge 32 during operation of the compressor, and thus protects the scroll from damage.

Figure 6A:
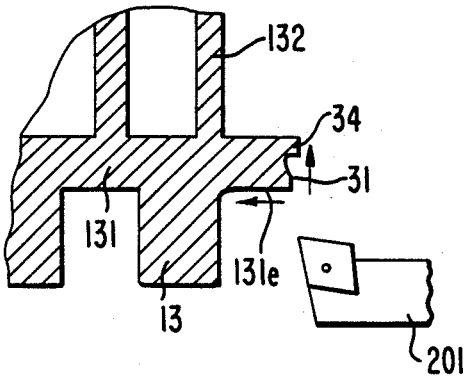
FIGS. 6*a* and 6*b* are partial sectional fragmentary schematic illustrations which show the cutting process used to form the sealing structure of FIG. 5.
Figure 6B:
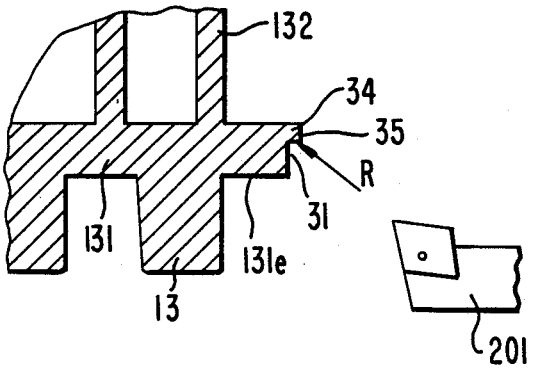
Figure 3A:
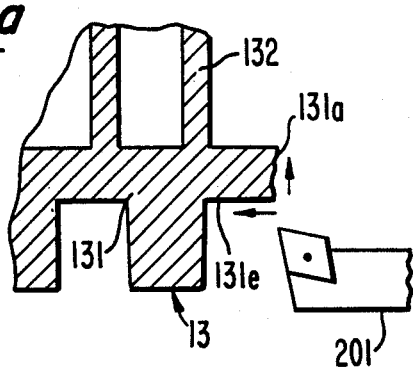
FIG. 3a PRIOR ART
FIGS. 3*a* through 3*g* are partial sectional fragmentary schematic illustrations which show the cutting process used in forming the circumferential groove in accordance with the prior art.
Figure 3E:
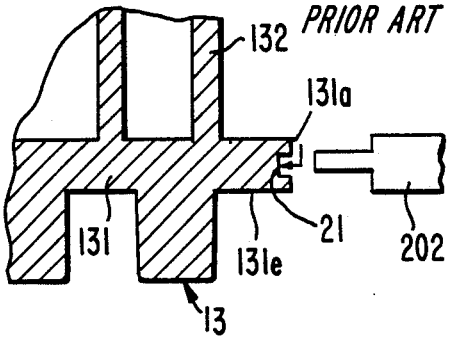
FIG. 3e PRIOR ART
Figure 3B:
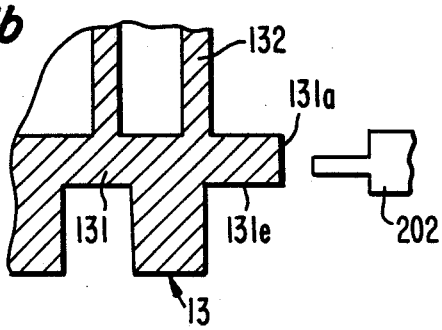
FIG. 3b PRIOR ART
Figure 3F:
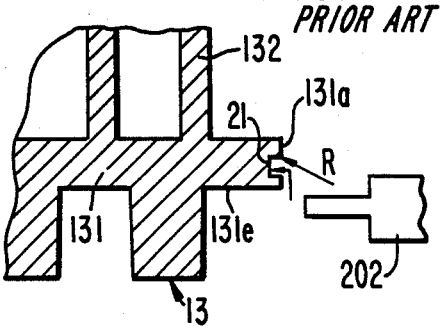
FIG. 3f PRIOR ART
Figure 3C:
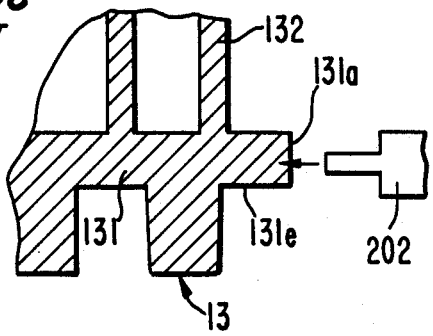
FIG. 3c PRIOR ART
Figure 3G:
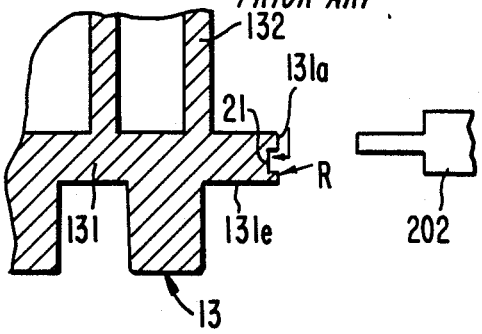
FIG. 3g PRIOR ART
Figure 3D:
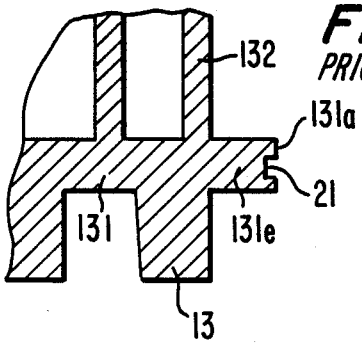
FIG. 3d PRIOR ART

Referring to FIGS. 6*a* and 6*b*, the formation of annular cut-out portion 31 is accomplished by a cutting process in which circular end plate 131 is mounted for rotation proximate a surface cutting tool 201, which is attached to a numerical controlled latch (not shown). In a first step, shown in FIG. 6*a*, cutting tool 201 is positioned to cut the outer circumferential portion 131*e* of the opposite surface of circular end plate 131. Then, as part of a continuous movement, cutting tool 201 is repositioned to cut the outer peripheral surface of circular end plate 131 to thereby form annular cut-out portion 31 and a projection 34, located at the upper portion of the outer peripheral surface of circular end plate 131, as shown in FIG. 5. In the second step, shown in FIG. 6*b*, cutting tool 201 is repositioned, again as part of a continuous movement, to cut away a corner 35 formed by the lateral surface of annular cut-out portion 31 and the outer peripheral surface of projection 34.

Figure 7:
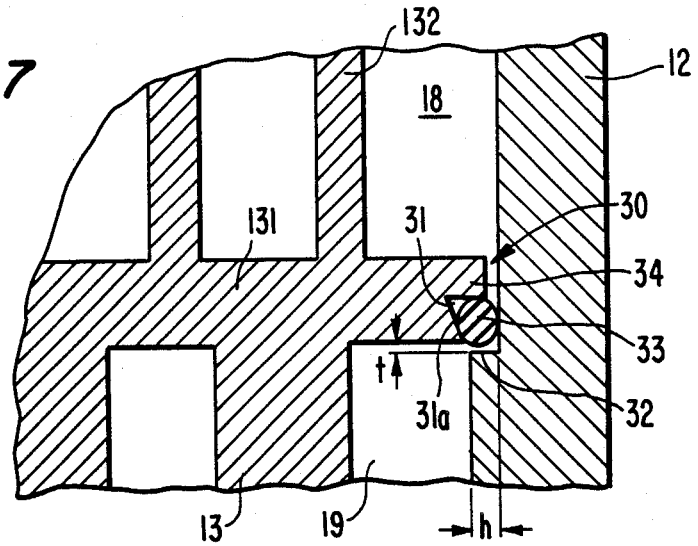
FIG. 7 is a partial sectional fragmentary schematic view which shows a sealing structure in accordance with a second embodiment of the present invention.

Referring to FIG. 7, a sealing structure 30 in accordance with a second embodiment of the present invention is shown. In this embodiment, the longitudinal surface 31*a* of annular cut-out portion 31 is slanted, and gradually extends toward the inner wall of casing 12.

Figure 8:
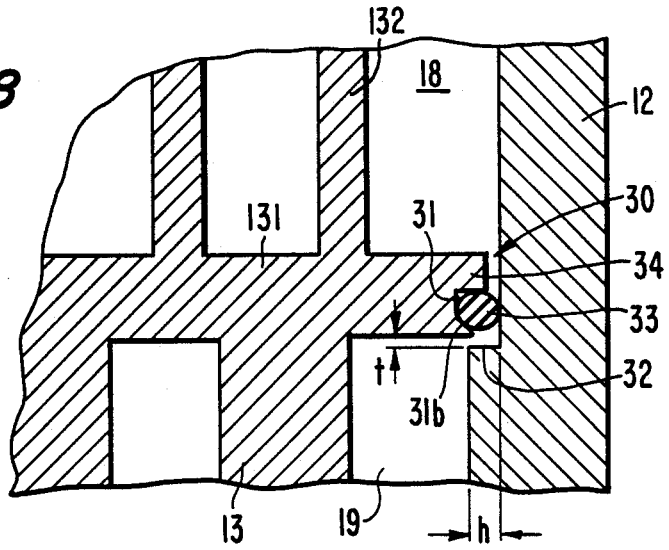
FIG. 8 is a partial sectional fragmentary schematic view which shows a sealing structure in accordance with a third embodiment of the present invention.

Referring to FIG. 8, a sealing structure 30 in accordance with a third embodiment of the present invention is shown. In this embodiment, the lower (relative to FIG. 8) part of the longitudinal surface 31*b* of annular cut-out portion 31 is slanted, and gradually extends toward the inner wall of casing 12.

Figure 9:
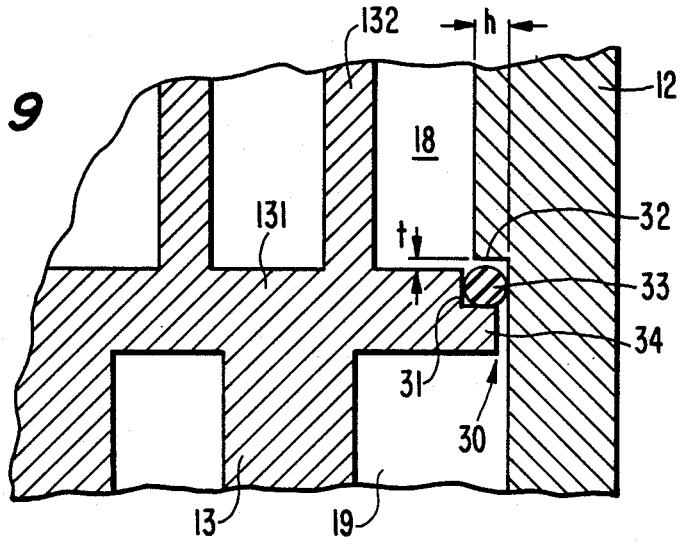
FIG. 9 is a partial sectional fragmentary schematic view which shows a sealing structure in accordance with a fourth embodiment of the present invention.

Referring to FIG. 9, a sealing structure 30 in accordance with a fourth embodiment of the present invention is shown. In this embodiment, both annular cut-out portion 31 and annular ridge 32 are located on the suction chamber side of circular end plate 131. Sealing structure 30, thus, comprises annular cut-out portion 31 formed at the upper (relative to FIG. 9) part of the outer peripheral surface of circular end plate 131, and annular ridge 32 is formed in the inner surface of suction chamber 18.

The annular cut-out portion 31 shown in each of FIGS. 7 and 8 is formed using the same two-step cutting process described above with respect to FIGS. 6*a* and 6*b*, except that the blade angle of the cutting tool used in the process will be different depending upon the configuration of cut-out portion 31.

This invention has been described in detail in connection with preferred embodiments. These embodiments, however, are merely for example only and the invention is not restricted thereto. It will be easily understood by those skilled in the art that other variations and modifications can easily be made within the scope of this invention, as defined by the appended claims.

We claim:

1. In a scroll type fluid compressor including a housing having a fluid input port and a fluid outlet port, a fixed scroll fixedly disposed within said housing and having an end plate from which a first spiral element extends, an orbiting scroll having an end plate from which a second spiral element extends, an inner chamber of said housing being partitioned into a front chamber disposed on the forward side of said end plate of said fixed scroll and a rear chamber disposed on the rearwardly facing side of said end plate of said fixed scroll, a sealing structure for insulating said front and rear chambers formed between the outer peripheral surface of said end plate of said fixed scroll and the inner peripheral wall of said housing, said scrolls being maintained angularly and radially offset from each other so that said first and second spiral elements interfit to form a plurality of line contacts between their spiral surfaces to thereby seal off and define at least one pair of fluid pockets, a driving mechanism operatively connected to said orbiting scroll to effect orbital motion of said orbiting scroll, and rotation preventing means for preventing rotation of said orbiting scroll so that the motion of said orbiting scroll relative to the fixed scroll shifts the line contacts along the spiral surfaces of said spiral elements to thereby change the volume of the fluid pockets, one of said chambers being associated with said fluid outlet port to receive compressed fluid from a centrally located fluid pocket formed by said scrolls during orbital motion, the improvement comprising:

said sealing structure including an annular cut-out portion, having an L-shaped sectional side view, formed in the outer peripheral surface of said end plate of said fixed scroll, an annular ridge formed in the inner peripheral wall of said housing and an O-ring seal element disposed between said annular cut-out portion and said annular ridge, said fixed scroll being mounted within said housing so that a radial gap is formed between the outer peripheral surface of the circular end plate and the inner peripheral wall of said housing, and said annular ridge being located in the inner wall of said housing at a distance from the circular end plate of said fixed scroll to create a gap between the surface of said end plate and the surface of said annular ridge when said fixed scroll is fixedly disposed in said housing.

2. The scroll type fluid compressor of claim 1 wherein said annular cut-out portion is formed in the rear chamber side of the outer peripheral surface of said end plate of said fixed scroll and said annular ridge is formed in the rear chamber side of the inner peripheral wall of said housing.

3. The scroll type fluid compressor of claim 1 wherein said annular cut-out portion is formed in the front chamber side of said outer peripheral surface of said end plate of said fixed scroll and said annular ridge is formed in the front chamber side of the inner peripheral wall of said housing.

4. The scroll type fluid compressor of claims 2 or 3 wherein said annular cut-out portion comprises a slanted longitudinal surface.

* * * * *